United States Patent [19]

Kawahara

[11] Patent Number: 4,611,923

[45] Date of Patent: Sep. 16, 1986

[54] ELECTRONIC TIMEPIECE WITH A DEPTH GAUGE

[75] Inventor: Hisashi Kawahara, Tokyo, Japan

[73] Assignee: Citizen Watch Co., Ltd., Tokyo, Japan

[21] Appl. No.: 802,645

[22] Filed: Nov. 27, 1985

[30] Foreign Application Priority Data

| | | | |
|---|---|---|---|
| Nov. 30, 1984 | [JP] | Japan | 59-252870 |
| Nov. 30, 1984 | [JP] | Japan | 59-252871 |
| Nov. 30, 1984 | [JP] | Japan | 59-252872 |
| Dec. 4, 1984 | [JP] | Japan | 59-256223 |
| Feb. 5, 1985 | [JP] | Japan | 60-20533 |

[51] Int. Cl.[4] ..... G04B 37/00

[52] U.S. Cl. ..... 368/10; 368/204

[58] Field of Search ..... 368/10, 201–204

[56] References Cited

U.S. PATENT DOCUMENTS

| | | | |
|---|---|---|---|
| 3,992,949 | 11/1976 | Edmondson | 368/10 |
| 4,109,140 | 8/1978 | Etra | 368/10 |
| 4,188,825 | 2/1980 | Farrar | 368/1 |
| 4,352,168 | 9/1982 | Anderson | 368/10 |
| 4,533,256 | 8/1985 | Ostendorf | 368/10 |

*Primary Examiner*—Bernard Roskoski

*Attorney, Agent, or Firm*—Townsend and Townsend

[57] ABSTRACT

In an electronic timepiece with a depth gauge, having a power supply battery, a timepiece circuit, a display unit, a water pressure sensor, a depth gauge circuit for receiving a sensor signal from the water pressure sensor and generating a water depth information signal, a mode control circuit for switching a timepiece mode and a depth gauge mode, and a display switching circuit for selectively displaying the time information signal from the timepiece circuit or the water depth information signal from the depth gauge circuit in response to a control signal from the mode control circuit, there are provided a battery voltage detector for detecting a voltage drop of the battery, and a waste time detector for detecting a nondive state represented by the depth gauge detector. The mode control circuit is forcibly set in the timepiece mode in response to a detection signal from the battery voltage detector or the waste time detector.

9 Claims, 6 Drawing Figures

ELECTRONIC TIMEPIECE WITH A DEPTH GAUGE

BACKGROUND OF THE INVENTION

The present invention relates to an electronic timepiece with a depth gauge.

U.S. Pat. Nos. 4,352,168 and 4,533,256 describe dive timers for displaying a depth and a bottom time during a dive.

Multifunctional watches have been developed and various functions are provided to electronic watches in recent years. Demand has recently become strong arisen for dive watches in the market, thus inevitably leading to demand for an electronic watch with a depth gauge. A depth gauge circuit is arranged as an additional function in a conventional electronic watch with a depth gauge which comprises a timepiece circuit, a display unit and a battery. The display unit and the battery are used in both time and depth display modes, and these modes are selectively performed upon switching.

In the conventional electronic watch with a depth gauge, the timepiece circuit and the depth gauge circuit are selectively used while the battery and the display unit are always used to perform time or depth display. For example, even when the battery voltage drops to disable normal operation of the depth gauge circuit, the depth gauge circuit is operated and displays an incorrect water depth which differs from the actual water depth. In this case, a user or diver believes the wrong depth displayed on his watch and continues to dive, endangering his life. Furthermore, external operation members (pushbuttons or the like) are mounted on the conventional electronic watch with a depth gauge. The waterproof property of the watch is degraded upon operation of the external operation members, and water may enter inside the watch.

SUMMARY OF THE INVENTION

It is an object of the present invention to eliminate the conventional drawbacks described above and to provide an electronic timepiece with a depth gauge which has high reliability and good operability.

In order to achieve the above object of the present invention, there is provided an electronic timepiece having the following arrangement. A battery voltage detector is arranged in the electronic timepiece to detect a decrease in battery voltage. When the battery voltage detector detects a decrease in voltage, a mode control circuit for switching the depth gauge circuit operation mode and the timepiece circuit operation mode is operated to disable the depth gauge circuit and restore the timepiece circuit operation mode. A non-contact switch such as a water pressure switch circuit for detecting a rapid change in water pressure is arranged to receive water depth information from the depth gauge circuit. Function switching can be automatically performed underwater without operating a button.

DESCRIPTION OF THE PREFERRED EMBODIMENTS

Figure 1:
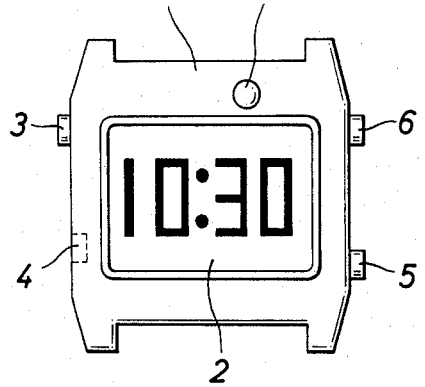
FIG. 1 is a front view of an electronic timepiece with a depth gauge for explaining a timepiece mode according to an embodiment of the present invention.

Preferred embodiments of the present invention will be described in detail with reference to the accompanying drawings. FIG. 1 shows an electronic timepiece with a depth gauge in the timepiece mode, and FIGS. 2A and 2B respectively show a water depth display mode and a dive timer display mode.

Figure 2A:
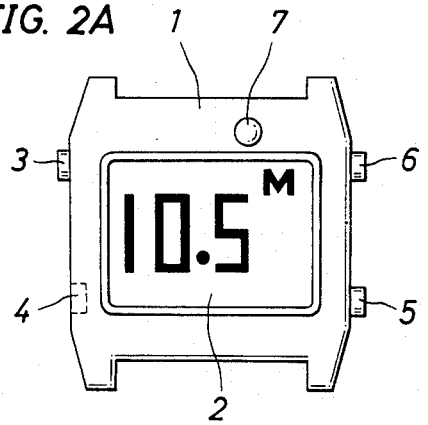
FIGS. 2A and 2B are front views of the timepiece for explaining a water depth display mode and a dive timer display mode, respectively.
Figure 2B:
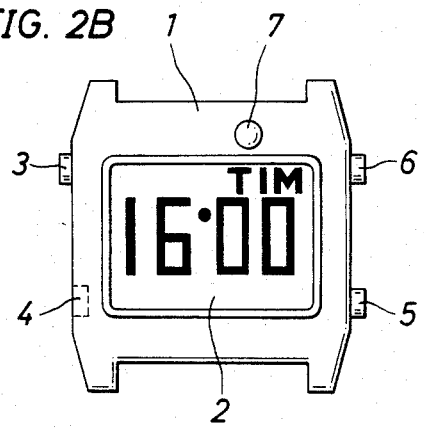

Referring to FIG. 1 and FIGS. 2A and 2B, reference numeral 1 denotes an electronic timepiece with a depth gauge; 2, a display unit; 3, a mode selection button; and 4 and 5, select and set buttons for correcting time and setting timer time. The select button 4 is fitted in the case to prevent an erroneous operation. Reference numeral 6 denotes a lamp button; and 7, a water pressure sensor. FIG. 1 shows a timepiece display state, showing 10:30, in this case. FIG. 2A shows a water depth display state, actually showing 10.5 meters, and FIG. 2B shows a dive timer display state, actually showing an allowable remaining time, i.e., 16 minutes.

Figure 3:
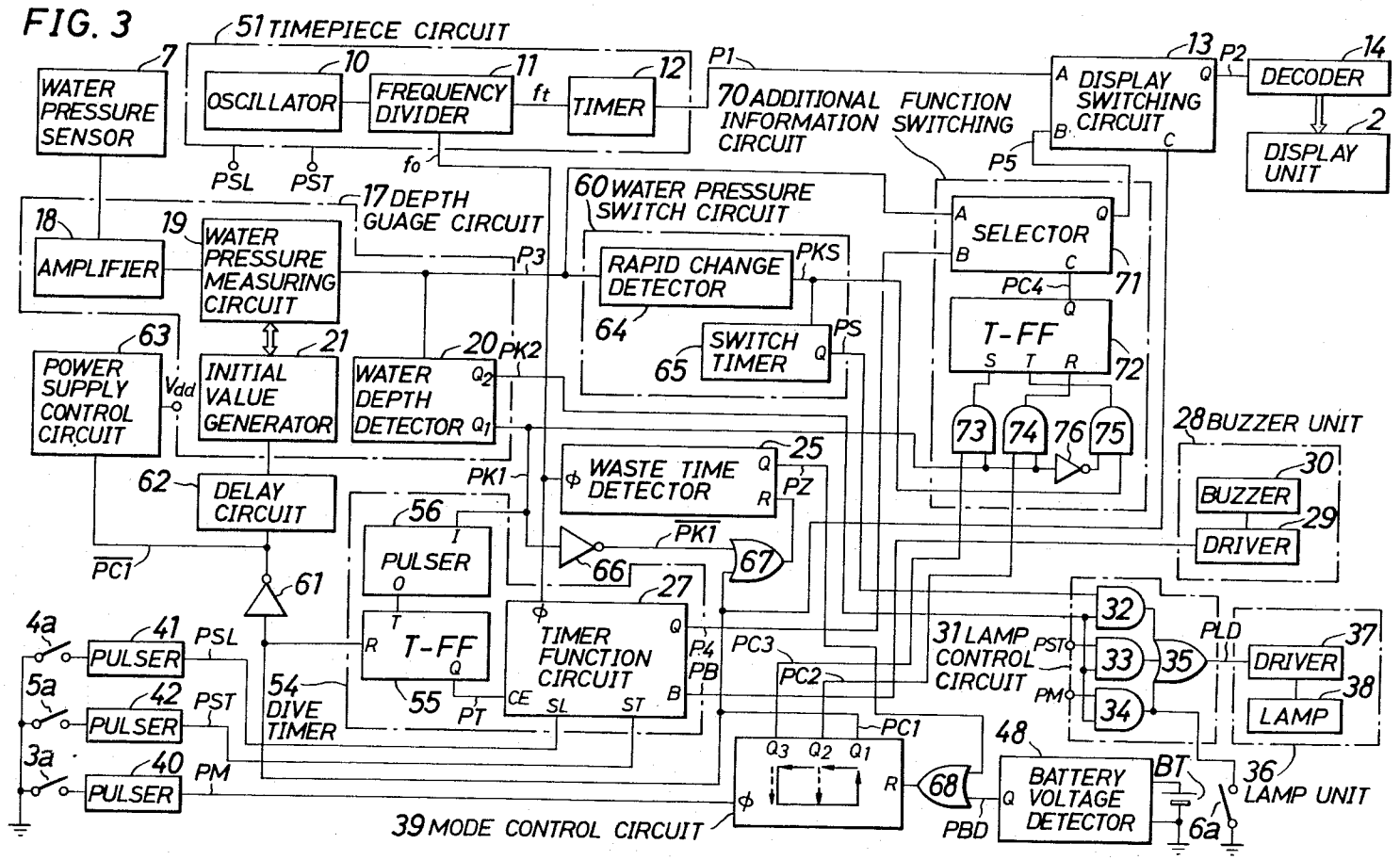
FIG. 3 is a block diagram of an electronic timepiece shown in FIG. 1.

FIG. 3 is a block diagram of the electronic timepiece shown in FIG. 1.

Reference numeral 51 denotes a timepiece circuit which has an oscillator 10, a frequency divider 11 and a timer 12. An oscillation signal from the oscillator 10 is supplied to the frequency divider 11, and the frequency divider 11 generates frequency-divided signals f0 and ft. The timer 12 is started in response to the frequency-divided signal ft and generates a time information signal P1. Reference numeral 13 denotes a display switching circuit, an input terminal A of which receives the time information signal P1 and an input terminal B of which receives an additional function information signal P5 from an additional function information switching circuit 70 (to be described in detail below). When a control terminal C of the circuit 70 is set at level "H" in response to a control signal PC1 to be described later, the additional function information switching circuit 70 generates the time information signal P1 as a display information signal P2. However, when the control terminal C of the circuit 70 is set at level "L", the circuit 70 generates the additional function information signal P5 as the display information signal P2.

Reference numeral 14 denotes a decoder which receives the display information signal P2 to cause the display unit 2 to perform time display (FIG. 1) or water depth/dive timer display (FIGS. 2A/2B). Reference numerals 3*a*, 4*a*, 5*a* and 6*a* denote switches controlled by operation buttons 3, 4, 5 and 6 of FIG. 1, respectively. More particularly, the switch 3*a* serves as a mode selection switch, 4*b*, a selection switch; 5*a*, a set switch; and 6*a*, a lamp switch. Reference numerals 40, 41 and 42 denote pulsers, respectively. The pulser 40 pulsates an operation signal from the mode selection switch 3*a* and generates a mode selection signal PM. The pulsers 41 and 42 pulsate operation signals from the switches 4a and 5a and generate a selection signal PSL and a set signal PST, respectively.

Reference numeral 39 denotes a mode control circuit which comprises a ternary shift register with three output terminals Q1, Q2 and Q3. The output terminals Q1, Q2 and Q3 are sequentially selected in response to the mode selection signal PM supplied to a clock terminal $\phi$ of the mode control circuit 39, as indicated by the solid lines. The output terminal Q1 of the mode control circuit 39 is forcibly reset in response to a signal supplied to a reset terminal R thereof.

When the output terminal Q1 of the mode control circuit 39 is specified, the mode control circuit 39 generates a timepiece function designation signal PC1. When the output terminal Q2 is specified, the circuit 39 generates a dive timer designation signal PC2. When the output terminal Q3 is specified, the circuit 39 generates a water depth designation signal PC3. Reference numeral 7 denotes a water pressure sensor shown in FIG. 1. The water pressure sensor 7 comprises a diaphragm type semiconductor pressure sensor for detecting a water pressure and generating an electrical sensor signal PP.

Reference numeral 17 denotes a depth gauge circuit which comprises an amplifer 18, a water pressure measuring circuit 19, a water depth detector 20 and an initial value setting circuit 21. The amplifier 18 amplifies the sensor signal PP, and an amplified signal is supplied to the water pressure measuring circuit 19. The water pressure measuring circuit 19 converts the analog sensor signal PP to a digital signal and a wafer depth information signal P3. The timepiece function designation signal PC1 is inverted by an inverter 61, and an inverted signal $\overline{PC1}$ is delayed by a delay circuit 62 for a predetermined period of time. The delayed signal is supplied to a trigger terminal T of the initial value setting circuit 21, thereby causing initialization of the setting circuit 21 in the following manner. When a predetermined period of time has elapsed after the mode control circuit 39 is changed from the timepice mode to a dive mode, i.e., the dive timer mode or the depth gauge mode (this time delay is required for stabilization of the depth gauge circuit 17 upon energization to be described later), the initial value generator 21 stores an initial pressure Vd measured by the water pressure sensor 7, the amplifier 18 and the water pressure measuring circuit 19. At the same time, the initial value setting circuit 21 generates as the water depth information signal P3 a value obtained by subtracting the initial value V0 from the measured pressure VD, as shown by equation (1) below:

$$P3 = Vd - VO \quad (1)$$

However, at the time of initialization, since relation Vd=VO is established, a display value represented by the water depth information signal P3 is 0 meter. The above description is concerned with initialization of the generator 21. Thereafter, the dive operation is started, and a water pressure acts on the water pressure sensor 7. In this case, the water depth information signal P3 representing a value obtained by increasing the measured pressure value by ΔVd is given by equation (2) below:

$$P3 = (Vd + \Delta Vd) - VO \quad (2)$$

Substitution of Vd=VO into equation (2) yields equation (3) below:

$$P3 = \Delta Vd \quad (3)$$

Thus, the display value represented by the water depth information signal P3 is an increment ΔVd of the pressure acting on the water pressure sensor 7 upon diving.

Necessity of initialization will be described below.

Assume that the electronic timepiece with a pressure gauge is used in the sea and a mountain lake. When the initial value is not set, a difference between a pressure on the sea water surface and a pressure on the water surface of the mountain lake due to a difference between atmospheric pressures causes a difference of pressures applied to the water pressure sensor 7. This leads to a difference between display values represented by the water depth information signals P3. When the user starts diving under this condition, a proper water depth display cannot be performed. In order to solve this problem, a variable resistor is arranged in the amplifier 18 in the depth gauge circuit 17 to adjust an offset value in the conventional electronic watch with a pressure gauge. The resistance of the variable resistor is adjusted by an external operation member such as a crown to display a water surface pressure to be zero in the conventional electronic watch with a depth gauge. According to this embodiment, an offset caused by use at different atmospheric pressures or by different temperature conditions of the pressure sensor can be automatically adjusted. Therefore, pressure changes caused by only water pressures can be extracted as the water depth information signal P3.

The water depth detector 20 receives the water depth information signal P3 from the water pressure measuring circuit 19 and performs preset water depth detection. The water depth detector 20 then generates a first water depth detection signal PK1 representing a depth range of 0 to 1 meter, i.e., a nondiving state, and a second water depth detection signal PK2 representing a depth range of 30 to 40 meters or more, i.e., a deep, dark underwater state from the output terminals Q1 and Q2 thereof.

Reference numeral 63 denotes a power supply control circuit which is enabled in response to only the inverted signal $\overline{PC1}$ of the timepiece function designation signal PC1. The power supply control circuit 63 supplies a power supply voltage to a power supply terminal Vdd of the depth gauge circuit 17.

Reference numeral 60 denotes a water pressure switch circuit which comprises a rapid change detector 64 and a switch timer 65. The rapid change detector 64 receives the water depth information signal P3 from the water pressure measuring circuit 19 and is operated in response to a rapid pressure change due to normal diving. The rapid change detector 64 generates a water pressure rapid change pulse signal PKS. The switch timer 65 is operated in response to the water pressure rapid change signal PSK from the rapid change detector 64 and generates a switch signal PS with a predetermined duration at the output terminal Q thereof.

Reference numeral 25 denotes a waste time detector. A reset terminal R of the detector 25 receives through an OR gate 67 a signal $\overline{PK1}$ obtained by inverting the first water depth detection signal PK1 from the water depth detector 20 by an inverter 66. The reset terminal R of the detector 25 also receives the timepiece function designation signal PC1 from the mode control circuit 39. through an OR gate 67. A clock terminal $\phi$ of the waste time detector 25 receives the frequency-divided signal f0 from the frequency divider 11. The waste time detector 25 counts the inverted signal PK1 of level "L" and the timepiece function designation signal $\overline{PC1}$ of lever "L" in response to the clock signal f0. When a predetermined period of time (10 minutes in this embodiment) has elapsed, the waste time detector 25 generates a time up signal PZ.

Reference numeral 54 denotes a dive timer which comprises a pulser 56, a T-FF 55 and a timer function circuit 27. The pulser 56 receives the first water depth detection signal PK1 from the water depth detector 20 and generates pulses respectively at the leading and trailing edges of the first water depth detection signal PK1. The T-FF 55 receives the pulse signal from the pulser 56 and performs inversion operation, thereby generating a timer control signal PT. The timepiece function designation signal PC1 is supplied to the reset terminal R of the T-FF 55, so that the T-FF 55 is rendered inoperative in the timepiece mode. The timer function circuit 27 comprises a timer circuit which is operated in response to the timer control signal PT supplied to a count control terminal CE thereof. The timer function circuit 27 generates the timer operation time information as a timer information signal P4 from an output terminal Q thereof in response to the selection signal PSL supplied to a selection terminal SL thereof and the set signal PST supplied to a set terminal ST thereof. The timer function circuit 27 also performs a subtraction in response to the clock signal f0 supplied to a clock terminal $\phi$ thereof and generates a time up signal PB from its output terminal B when the subtraction is completed.

Reference numeral 28 denotes a buzzer unit which comprises a driver 29 and a buzzer 30. When the time up signal PB is supplied from the timer 54 to the driver 29, the driver 29 operates the buzzer 30 for a predetermined period of time, thereby signalling to the diver that the time is up.

Reference numeral 70 denotes an additional function information switching circuit which comprises a selector 71, a T-FF 72 with set and reset terminals, AND gates 73, 74 and 75, and an inverter 76. The water depth information signal P3 is supplied from the water pressure measuring circuit 19 to an input terminal A of the selector 71. The timer information signal P4 is supplied from the timer function circuit 27 to an input terminal B of the selector 71. When a control terminal C of the selector 71 is set at level "H", the water depth information signal P3 supplied to the input terminal A is selected as an additional function information signal P5 which appears at its output terminal Q. However, when the control terminal C is set at level "L", the timer information signal P4 supplied to the input terminal B appears as the additional function information signal P5.

The T-FF 72 comprises a T-FF with set/reset priority. When a set terminal S of the T-FF 72 is set at level "H", its output terminal Q is set at level "H". However, when a reset terminal R is set at level "H", the output terminal Q is forcibly compulsorily set at level "L". Only when the set and reset terminals S and R are both set at level "L", the output terminal Q is inverted for every signal input to a toggle terminal T of the T-FF 72. An output signal from the output terminal Q of the T-FF 72 is supplied as a switching control signal PC4 to the control terminal C of the selector 71.

The AND gates 73 and 74 are enabled when the first water depth detection signal PK1 from the water depth detector 20 is set at level "H". The AND gate 75 is enabled when the first water depth detection signal PK1 is set at level "L". The water depth designation signal PC3, the dive timer designation signal PC2 and the rapid change detection signal PKS are supplied to the set terminal S, the reset terminal R and the toggle terminal T, respectively, of the T-FF 72.

The additional function information switching circuit 70 is operated as follows. In the water depth gauge mode, when the first water depth detection signal PK1 is generated by the water depth detector 20, that is, when diving is not performed, the AND gate 73 is enabled. The selector 71 controlled in response to the output from the T-FF 72 is switched in response to the water depth designation signal PC3 and the dive timer designation signal PC2 which are generated by the mode control circuit 39. When the water depth detection signal PK1 is not generated, that is, while diving is being performed, the AND gate 75 is enabled. The additional function information switching circuit 70 is switched in response to the water pressure rapid change signal PSK from the water pressure switch circuit 60.

Reference numeral 31 denotes a lamp control circuit which comprises AND gates 32, 33 and 34 and an OR gate 35. The second water depth detection signal PK2 from the water depth detection circuit 20 is supplied to the first input terminals of the AND gates 32, 33 and 34, and the switch signal PS from the switch timer 65 in the water pressure switch circuit 60, the set signal PST as the operation signal from the set switch 5*a*, and the mode selection signal PM as the operation signal from the mode selection switch 3*a* are supplied to the second input terminals of the AND gates 32, 33 and 34, respectively. Four input terminals of the OR gate 35 are connected to the output terminals of the AND gates 32, 33 and 34 and the lamp switch 6*a*. A lamp ON signal PLD appears at the output terminal of the OR gate 35.

Reference numeral 36 denotes a lamp unit which comprises a driver 37 and a lamp 38. The lamp ON signal PLD from the lamp control circuit 31 causes the lamp 38 to turn on to drive the display unit 2. In the normal operation wherein the second water depth detection signal PK2 is not generated by the water depth detector 20, the lamp control circuit 31 causes the lamp 38 to turn on in response to only the lamp ON signal PLD. However, when the water depth detector 20 generates the second water depth detection signal PK2 representing a depth of 30 meters or more, the AND gates 32, 33 and 34 are enabled, so that all lamp ON signals PLD generated upon operations of the mode selection switch 3*a*, the set switch 5*a* and the water pressure switch signal PLD can drive the lamp 38.

Reference nummeral 48 denotes a battery voltage detector which generates a voltage drop detection signal PBD upon detection of a voltage drop of a battery BT. The voltage drop detection signal PBD is supplied to the reset terminal R of the mode control circuit 39 through the OR gate 68.

The operation of the electronic timepiece with a depth gauge having the arrangement described above will be described hereinafter.

In the timepiece mode shown in FIG. 1, the output terminal Q1 of the mode control circuit 39 is specified, and the timepiece function designation signal PC1 is generated. The display switching circuit 13 generates as the display information signal P2 the time information signal P1 supplied to the input terminal A thereof. The time information signal P1 is supplied to the display unit 2 through the decoder 14, so that time 10:30 is displayed on the display unit 2, as shown in FIG. 1. The dive timer 54 and the waste time detector 25 are reset in response to the timepiece function designation signal $\overline{PC1}$ and are rendered inoperative. The power supply control circuit 63 is disabled in response to the inverted signal PC1. As a result, the depth gauge circuit 17 is deenergized.

In the timepiece mode, all the AND gates 32, 33 and 34 in the lamp control circuit 31 are kept off, so that only the lamp switch 6*a* can drive the lamp 38. This indicates that the lamp 38 is turned on upon operation of only the lamp button 6 of FIG. 1.

The user can operate the selection button 4 and the set button 5 to correct time information displayed on the display unit 2 in accordance with a known method. The above description is concerned with the operation of the electronic watch in the timepiece mode. The operations of the electronic timepiece in the drive mode will be described below.

The timepiece mode is switched to the dive mode upon operation of the mode selection button 3. When the mode selection button 3*a* is depressed once, the output terminal Q2 of the mode control circuit 39 is switched in response to the mode selection signal PM supplied to the clock terminal $\phi$, as indicated by the solid arrow. The mode control circuit 39 thus generates the dive timer designation signal PC2. As a result, the timepiece function designation signal PC1 is inverted to level "L", and the display switching circuit 13 is switched to a selection state represented by the additional function information signal P5 supplied to the input terminal B thereof. The reset status of the waste time detector 25 is released, and the detector 25 starts counting time in response to the clock signal f0. The reset status of the dive timer 54 is released, so that it is held in the ready state. When the inverted signal $\overline{PC1}$ goes to level "H", the power supply control circuit 63 is started to supply power to the depth gauge circuit 17. In this state, the depth gauge circuit 17 starts measuring the water pressure in accordance with the sensor signal PP from the water pressure sensor 7. Upon operation of the power supply control circuit 63, the delay circuit 62 is also operated. When a predetermined period of time (60 seconds in this embodiment) has elapsed, the delay circuit 62 supplies the initalization signal PV to the initial value setting circuit 21. The initial value is set in the depth gauge circuit 17, and water pressure measurement is started. However, in this state, the diver has not dived yet, so that the first and second water depth detection signals PK1 and PK2 from the water depth detector 20 are respectively set at level "H" and level "L".

Upon generation of the dive timer designation signal PC2, the T-FF 72 in the additional function information switching circuit 70 is forcibly reset to disable the switching control signal PC4. The selector 71 is set in a state to select the timer information signal P4 supplied to the input terminal B thereof. As a result, the timer information signal P4 is displayed on the display unit 2 through the additional function information switching circuit 70 and the display switching circuit 13, as shown in FIG. 2B. The diver operates the selection button 4 and the set button 5 while he visually checks the dive display content. As a result, the timer time required for the timer function circuit 27 can be set.

This is the setting operation of the timer. When the necessary timer time is completed, the mode selection switch 3*a* is operated again to specify the output terminal Q3 of the mode control circuit 39 again, thereby setting the water depth display mode shown in FIG. 2A.

In this mode, the output terminal Q3 of the mode control circuit 39 is specified, so that the depth gauge designation signal PC3 is generated. At the same time, the dive timer designation signal PC2 at the output terminal Q2 disappears, so that the T-FF 72 in the additional function information switching circuit 70 is set and the switching control signal PC4 is set at level "H". The selector 71 is set in the state to select the water depth information signal P3 supplied to the input terminal A thereof. As a result, the water depth information signal P3 is supplied to the display unit 2 through the additional function information switching circuit 70 and the display switching circuit 13, so that a water depth is displayed as shown in FIG. 2B.

The diving operation will be described wherein a user carries the electronic timepiece 1 set in the dive mode upon a series of operations and is going to dive.

Before diving, the water depth information signal P3 from the depth gauge circuit 17 represents 0 meter upon the initialization described above. The first water depth detection signal PK1 from the water depth detector 20 is set at level "H".

When the user starts to dive and the depth exceeds 1 meter, the water depth detector 20 detects the water depth information signal P3, and the first water depth detection signal PK1 goes to level "L". The waste time detector 25 is reset again in response to level "H" of the signal $\overline{PK1}$ inverted by the inverter 66. The count of the waste time detector 20 is cleared. The output from the T-FF 55 in the dive timer 54 is inverted in response to the pulse from the pulser 56 upon inversion of the first water depth detection signal PK1. The timer control signal PT is supplied to the count control circuit CE, so that the timer function circuit 27 starts decrementation of the timer time. In the additional function information switching circuit 70, the AND gate 75 is enabled through the inverter 76 while the AND gates 73 and 74 are kept off, and compulsory designation mode of display switching synchronized with the dive timer designation signal PC2 and the water depth designation signal PC3 from the mode control circuit 39 is inhibited. The T-FF 72 performs inversion switching in response to the water pressure rapid change signal PKS supplied by the water pressure switch circuit 60 to the toggle terminal T through the AND gate 75.

During the dive at a depth of 1 meter or more, the diver rapidly moves his hand with the electronic timepiece 1, and a rapidly changing pressure is applied to the water pressure sensor 7. The depth gauge and dive timer display modes of the display unit 2 can be alternately set. Therefore, the diver need not depress the buttons to arbitrarily set the depth gauge or dive timer display mode. When the diver continues to dive and the depth exceeds 30 meters, the water depth detection circuit 20 detects the water depth information signal P3 and generates the second water depth detection signal PK2. All the AND gates 32, 33 and 34 in the lamp control circuit 31 are turned on by the signal PK2. All the lamp button 6, the mode selection button 3 and the set button 5 have the lamp ON function. Therefore, the lamp 38 is turned on for a time width of the switch signal PS upon operation of the water pressure switch 60.

During the dive, when the depth exceeds 30 meters, i.e., the diver cannot easily read the display due to darkness, the lamp 38 is turned on upon operation of the water pressure switch circuit 60, thereby eliminating manual operation of the lamp button 6. When an emergency occurs in deep water where diver's judgment cannot often be normal, the diver can depress any of the buttons to turn on the lamp 38.

When the diver continues to dive and the timer time preset in the dive timer 54 has elapsed, the time up signal PB appears at the output terminal B of the timer function circuit 27, and an alarm sound is generated by the buzzer unit 28. The diver starts to ascend to the water surface in response to the alarm sound. When the depth during ascending becomes less than 30 meters, the second water depth detection signal PK 2 is no longer generated by the water depth detector 20, thereby rendering the lamp control circuit 31 inoperative. When the diver further ascends to a depth of 1 meter or less, the water depth detector 20 generates the first water depth detection signal PK1 again. As a result, the T-FF 55 in the dive timer 54 is inverted, so that the dive timer 54 is set in the ready state. At the same time, the additional function information switching circuit 70 restores the compulsory designation mode. The reset state of the waste time detector 25 is cancelled in response to the inverted signal $\overline{PK1}$ from the inverter 66. The waste time detector 25 starts counting the time. When a predetermined period of time (10 minutes in this embodiment) has elapsed after the diver floats on the water surface, the time up signal PZ is generated by the waste time detector 25 to reset the mode control circuit 39 through the OR gate 68. As a result, the output terminal Q1 of the mode control circuit 39 is forcibly specified, as indicated by the broken arrow of FIG. 3. The timepiece function designation signal PC1 is generated by the mode control circuit 39, thereby restoring the timepiece mode of FIG. 1.

The restoration operation of the waste time detector 25 to the timepiece function prevents wasteful current consumption of the depth gauge circuit 17 when the depth gauge mode is accessed upon erroneous depression of the mode selection button 3 or when the diver forgets to cancel the depth gauge mode after diving is completed. When the diver notices that the depth gauge mode is kept set after diving, he depresses the mode selection button 3 to manually restore the initial state of the mode selection circuit 39, thereby preventing wasteful current consumption. The above description exemplifies the normal operation when the voltage at the battery BT is sufficiently high. The operation of the electronic timepiece will be described wherein the battery BT is almost dead.

When the voltage at the battery BT is lower than a predetermined voltage, the battery voltage detector 48 detects a voltage drop and generates a voltage drop detection signal PBD. The signal PBD is supplied to the mode control cricuit 39 through the OR gate 68, so that the circuit 39 is kept reset.

When the voltage drop detection signal PBD is generated, the mode control circuit 39 is forcibly held in the timepiece mode. The depth gauge mode as the additional function cannot be set. The depth gauge function is inhibited in an unstable state, which may endanger diver's life, where the battery voltage is decreased, thereby improving reliability of the electronic timepiece as a measuring instrument.

Figure 4:
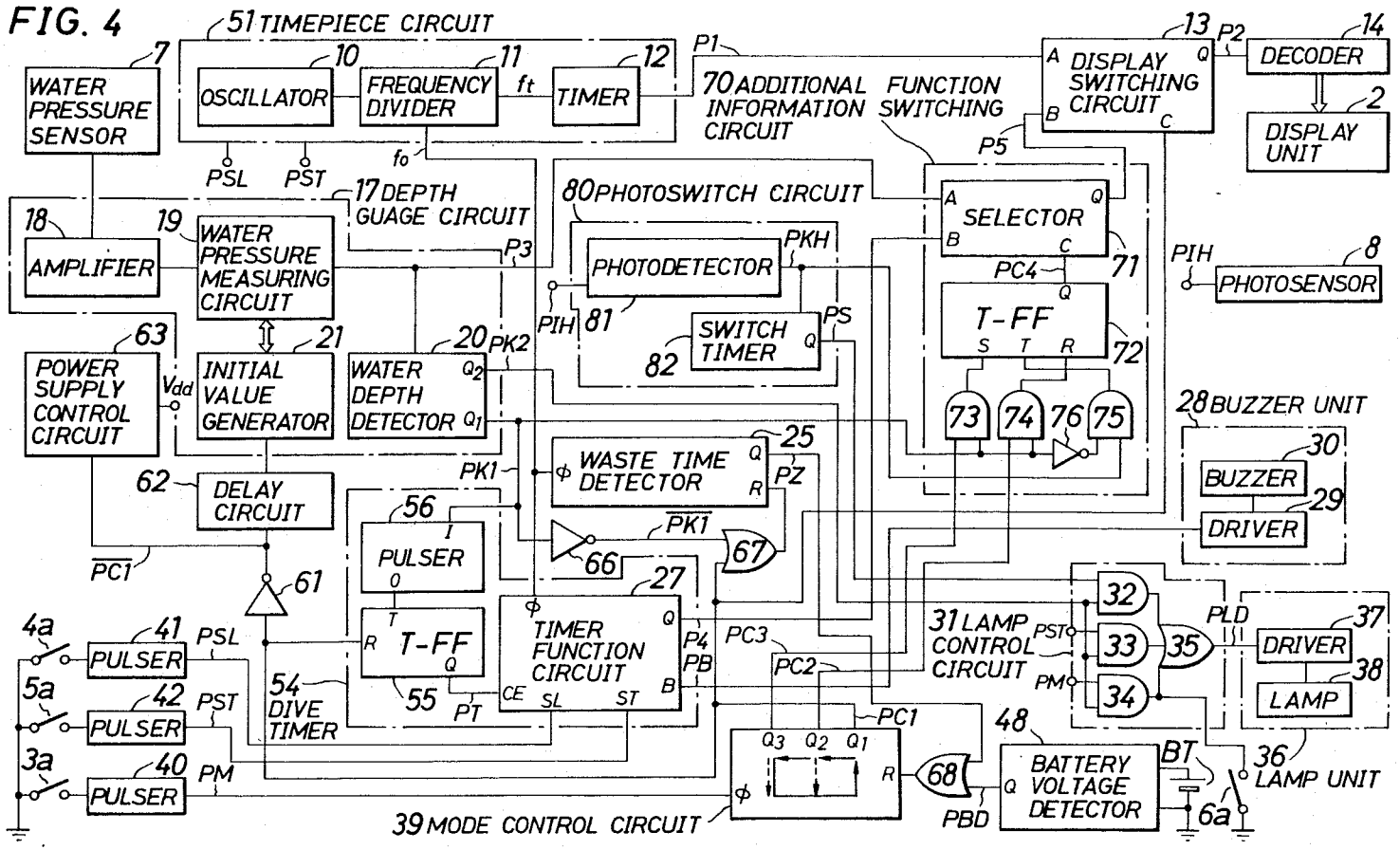
FIG. 4 is a block diagram of an electronic timepiece with a depth gauge according to another embodiment of the present invention.

FIG. 4 is a block diagram of an electronic timepiece with a depth gauge according to another embodiment of the present invention. The basic system configuration of the electronic timepiece of this embodiment is substantially the same as that of the previous embodiment, except that a photoswitch circuit 80 is used in place of the water pressure switch circuit 60 and a photosensor 8 is arranged to supply a photo input signal PIH to the photoswitch circuit 80.

The photosensor 8 is arranged at a position where external light incident on an electronic watch 1 can be detected (to be described in detail later). The photoswitch circuit 80 comprises a photodetector 81 for generating the photo input signal PIH as a photo rapid change pulse signal PKH and a switch timer 82 for receiving the photo rapid change signal PKH and generating a switch signal PS with a predetermined duration at its output terminal Q. The control function obtained by the photo rapid change signal PKH and the switch signal PS is the same as that obtained by the water pressure rapid change signal PKS and the switch signal PS in FIG. 3.

Figure 5:
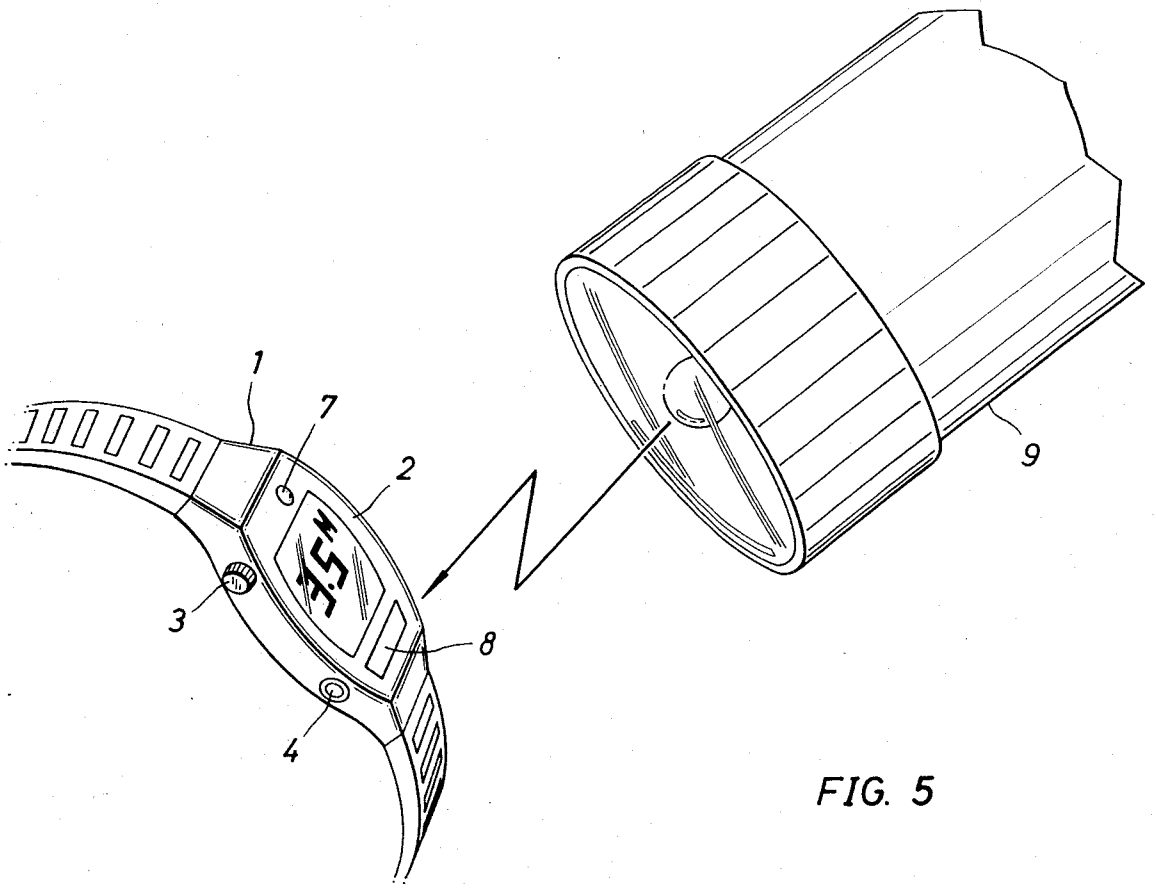
FIG. 5 is a perspective view for explaining a light input to the electronic timepiece shown in FIG. 4.

FIG. 5 is a perspective view showing a photo input state of the electronic timepiece 1 of FIG. 4. An underwater light 9 is turned on to emit light toward the photosensor 8 arranged below the display unit 2, thereby selectively setting the dive timer display mode of FIG. 2B or the depth gauge display mode of FIG. 2A.

As is apparent from the above description, according to the present invention, when the voltage at the battery drops to result in an unstable operation and fails to provide normal operation, the timepiece mode is not switched to the depth gauge mode, thereby inhibiting use of the timepiece as the depth gauge while the depth gauge circuit is not normally operating. Safety of diver's life is gauranteed. Furthermore, underwater display mode switcing and lamp ON operation can be performed without touching the water pressure switch or the photoswitch. In this manner, underwater button operation which may cause water to enter inside the watch housing need not be performed. Therefore, a highly reliable electronic watch with a depth gauge can be achieved.

What is claimed is:

1. An electronic timepiece with a depth gauge, having a power supply battery, a timepiece circuit, a display unit, a water pressure sensor, a depth gauge circuit for receiving a sensor signal from said water pressure sensor and generating a water depth information signal, a mode control circuit for switching a timepiece mode and a depth gauge mode, and a display switching circuit for selectively displaying a time information signal from said timepiece circuit or the water depth information signal from said depth gauge circuit in response to a control signal from said mode control circuit, characterized by a battery voltage detector for detecting a voltage drop of said battery, and the arrangement such that said mode control circuit is rendered inoperative in response to a detection signal from said battery voltage detector, and the depth gauge mode is inhibited when the battery voltge drops below a predetermined voltage.

2. An electronic timepiece according to claim 1, wherein said depth gauge circuit comprises: an amplifier for amplifying the senor signal from said water pressure sensor; a water pressure measuring circuit for converting an analog signal from said amplifier to a digital signal and generating the digital signal as the water depth information signal; and an initial value setting circuit for receiving the water depth information signal from said water pressure measuring circuit, storing an initial water depth information signal as an initial datum, and for calculating a difference between the initial datum and the second or subsequent water depth information signals and providing a difference datum as an output signal from said depth gauge circuit.

3. An electronic timepiece according to claim 1, wherein said depth gauge circuit comprises: an amplifier for amplifying the sensor signal from said water pressure sensor; a water pressure measuring circuit for converting an analog signal from said amplifier to a digital signal and generating the digital signal as the water depth information signal; and a water depth detector for receiving the water depth information signal from said water pressure measuring circuit, detecting that a depth represented by the water depth information signal has reached a predetermined depth, and generating a water depth detection signal.

4. An electronic timepiece according to claim 3, further comprising:

a waste time detector operative in response to a first water depth detection signal generated by said water depth detector, when said water depth detector detected that a current depth is smaller than the predetermined depth, said waste time detector being adapted to measure a duration of the first water depth detection signal; and a power supply control circuit for interrupting power supply to said depth gauge circuit in response to a time up signal generated by said waste time detector when said waste time detector detected elapse a predetermined period of time.

5. An electronic timepiece according to claim 4, wherein the time signal from said waste time detector controls said mode control circuit to restore the timepiece mode from the depth gauge mode.

6. An electronic timepiece according to claim 3, further comprising a dive timer, enabled/disabled in response to the first water depth detection signal from said water depth detector, for measuring a time in which the first water depth detection signal is not generated.

7. An electronic timepiece according to claim 6, further comprising an additional function information switching circuit for selectively displaying the water depth information signal from said depth gauge circuit or a dive time remaining information signal from said dive timer on said display unit.

8. An electronic timepiece according to claim 7, further comprising a water pressure switch circuit for receiving the water depth information signal from said depth gauge circuit and generating a water pressure rapid change signal representing a rapid change in water pressure represented by the water depth information signal, said additional function information switching circuit being switched in response to the water pressure rapid change signal.

9. An electronic timepiece according to claim 7, further comprising a photosensor for detecting external light incident on said watch and a photoswitch circuit for receiving a sensor signal from said photosensor and generating a photo rapid change signal, said additional function information switching circuit being switched in response to the photo rapid change signal.

* * * * *